US007147551B2

(12) United States Patent
Meyer-Weingaertner

(10) Patent No.: US 7,147,551 B2
(45) Date of Patent: Dec. 12, 2006

(54) APPARATUS FOR DETECTING A COIN IN A COIN TUBE OF A MONEY CHANGER FOR AN AUTOMATIC COIN MACHINE

(75) Inventor: Heinz Werner Meyer-Weingaertner, Hollenbeck (DE)

(73) Assignee: National Rejectors, Inc. GmbH, Buxtehude (DE)

( * ) Notice: Subject to any disclaimer, the term of this patent is extended or adjusted under 35 U.S.C. 154(b) by 152 days.

(21) Appl. No.: 10/816,379

(22) Filed: Apr. 1, 2004

(65) Prior Publication Data

US 2004/0198210 A1 Oct. 7, 2004

(30) Foreign Application Priority Data

Apr. 2, 2003 (DE) ..... 203 05 319 U

(51) Int. Cl.
*G07D 9/06* (2006.01)

(52) U.S. Cl. ..... 453/16

(58) Field of Classification Search ..... 453/16, 453/17, 61, 62, 63; 194/350; 250/559.12; 359/836

See application file for complete search history.

(56) References Cited

U.S. PATENT DOCUMENTS 4,374,529 A 2/1983 Kobayashi et al. ..... 453/17
4,413,718 A * 11/1983 Dean ..... 194/344
4,541,547 A * 9/1985 Miknyocki et al. ..... 221/260
5,485,906 A 1/1996 Newton et al. ..... 194/203
5,501,633 A * 3/1996 Watkins et al. ..... 453/17
5,788,046 A * 8/1998 Lamah ..... 194/317
5,830,055 A * 11/1998 Jones et al. ..... 453/41
6,044,952 A * 4/2000 Haggerty et al. ..... 194/207
6,827,647 B1 * 12/2004 Loose et al. ..... 463/25

FOREIGN PATENT DOCUMENTS

DE 88 00 692.1 6/1988
DE 29 31 994 12/1988
DE 198 48 949 A1 5/1999

* cited by examiner

*Primary Examiner*—Patrick Mackey
*Assistant Examiner*—Mark J. Beauchaine
(74) *Attorney, Agent, or Firm*—Vidas, Arrett & Steinkraus, P.A.

(57) ABSTRACT

A money changer for automatic coin machines, comprising a casing in which a plurality of serially arranged tubes are mounted to store coins in a column shape, light barriers associated to the tubes at least in the upper and lower regions with each light barrier having a light-emitting element and a light sensitive receiving element which are superposed on the same side of the coin tube whereas the opposite side of the coin tube has arranged thereon a prism which reflects the received light back to the receiving element, and a control circuit for the money changer into which the output signals of the light receiving elements are entered, wherein the casing has a wall portion in parallel with the series of the coin tubes, a printed circuit board for the control circuit is mounted on the opposite side on the wall portion and carries the light-emitting elements and light-receiving elements which are directed towards the respective coin tube via holes in the printed circuit board and in the wall portion.

16 Claims, 5 Drawing Sheets

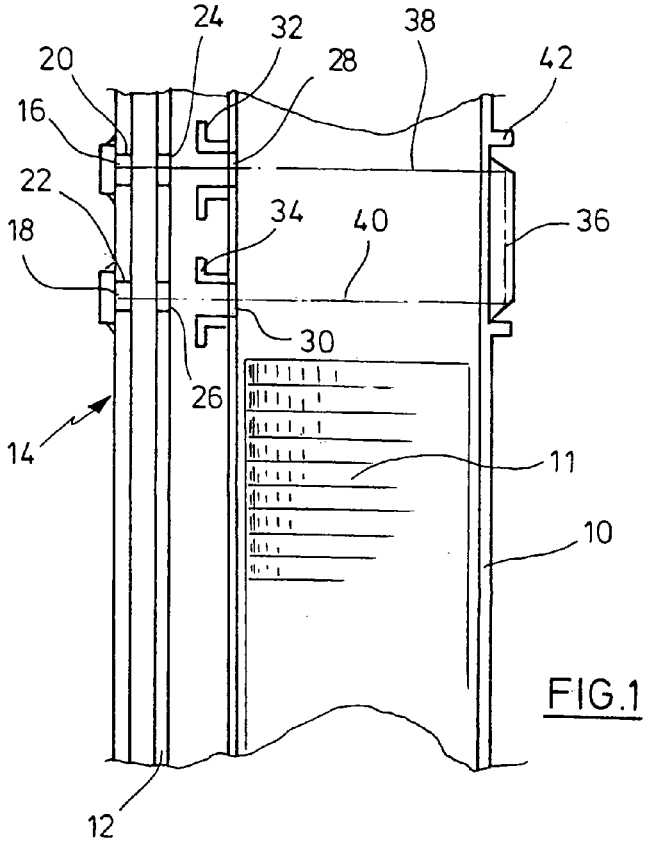
FIG.1
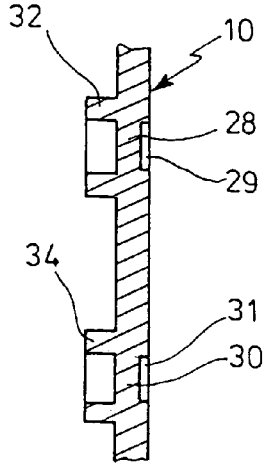
FIG.1a
FIG.2
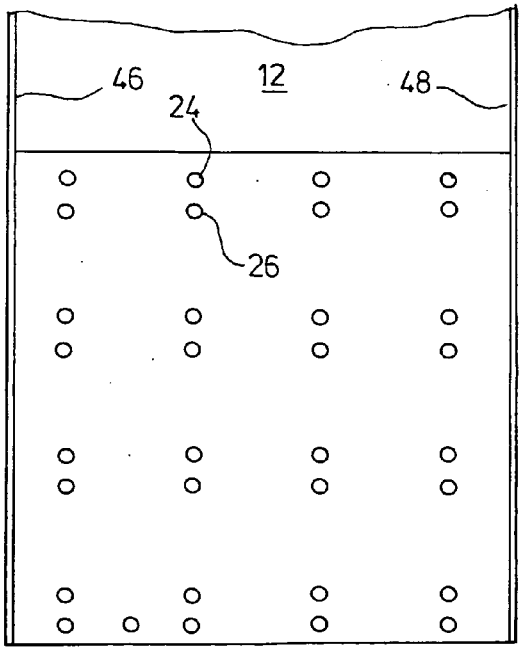
FIG.3
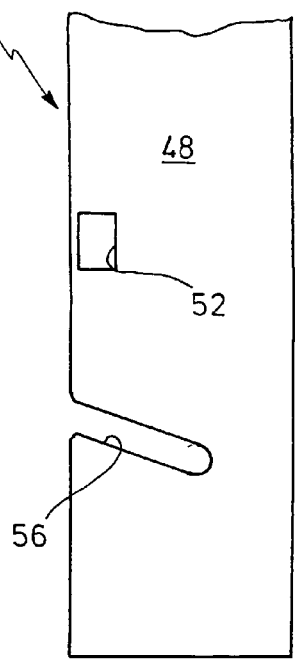

APPARATUS FOR DETECTING A COIN IN A COIN TUBE OF A MONEY CHANGER FOR AN AUTOMATIC COIN MACHINE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

Automatic coin-accepting machines. in addition to incorporating a coin validator to check the trueness of the coins inserted, mostly have a money changer which reimburses the balance exceeding the price of the desired article or service in small change. For this purpose, the money changer has coin reservoirs from which the small change is reimbursed. The most frequent type of the coin reservoirs are so-called coin tubes in which the coins are stacked like in a column. Such known money changers have three or four coin tubes for the small change coins.

Although it is possible to monitor the filling level of the coin tubes by watching the insertion and delivery of coins the real number of coins in the coin tubes frequently does not agree with the number counted. Therefore, it is also known to arrange filling level sensors at the upper and lower ends of the coin tubes that emit a signal if the column of coins goes beyond an upper amount or falls below a lower amount. When the tube is full the coins will be routed directly into a cash-box. When the filling level falls below a predetermined lower degree the acceptance of coins is blocked or the customer is signaled that it is impossible to return small change.

Various sensors have become known to determine the filling level of coin tubes. A so-called light barrier is frequently used which has a light-emitting element and a light-sensitive receiving element. U.S. Pat. No. 4,413,718 has made it known to superpose the two elements on one side of a coin tube and to dispose a prism on the opposite side of a coin tube to reflect the light bean back to the receiving element. The advantage of such an arrangement is that the lines can be fed to the elements on the same side of the coin tube. Nevertheless, there is the disadvantage of the great expenditure in assembling the money changer with the coin tubes and the associated light barriers. Such expenditure will naturally increase with the number of light barriers. For example, a measurement of the filling level can be desired to be made between the ends of a coin tube. It would be necessary to provide three light barriers per coin tube in such case.

It is the object of the invention to provide a money changer for automatic coin machines, which is particularly easy to manufacture and assemble and involves minimal manufacturing expenditure, the accuracy of the light barriers being sufficient to measure the filling level in the coin tubes.

BRIEF SUMMARY OF THE INVENTION

In the inventive money changer, a casing is provided as is common. The casing normally is designed so as to accommodate the coin vacillator and the components of the money changer including the coin tubes. In the invention, a wall portion is provided in parallel with the series of the coin tubes in the casing on which a printed circuit board is arranged on the side opposite the coin tubes and contains the control circuit for the money changer and the light-emitting and receiving elements of the light barriers. The light-emitting and receiving elements are arranged so as to be directed towards the respective coin tube via holes in the printed circuit board. The wall portion has through openings in correspondence to the arrangement of the light-emitting and receiving elements. Therefore, the wall portion acts like a mask or shutter so that a light beam exits only in the area of the through opening, traverses the coin tube and is reflected from the prism, and enters again via a through opening for reception by means of the receiving element.

The arrangement of light barriers is extremely simple. The printed circuit board configured according to the SMD technique allows to appropriately assemble the light-emitting and receiving elements on the circuit board. The board can be placed even in a most easiest manner against the wall portion provided with through openings.

The wall portion which forms a mask has the additional advantage that it becomes possible to cover desired pairs of holes by simple actions if the filling level is not to be measured in the concealed area.

It is known to manufacture the coin tubes front plastic material. It is particularly beneficial for the coin tubes to be made of a light-transmissive material and the prisms to be integrally formed with the respective coin tube as it is in the invention. While the state of the art requires that the prisms be manufactured separately and be attached to the coin tubes in a suitable manner subsequently the prisms are integrally formed with the coin tubes here. This significantly reduces the expenditure in assembly.

In an aspect of the invention, inlet and outlet surface portions for the light beam on the coin tubes can be defined by windows in which the wall thickness of the coin tubes is smaller. This keeps low losses resulting from the repeated pass of the light beam through the material of the coin tube. Recesses may be provided at the inside in the region of the windows to prevent damage thereto by getting scratched or the like by the coins.

Another aspect of the invention provides that the transmission to light is higher in the region of the windows than is in other regions of the coin tubes. The windows can be composed of a crystal-clear portion whereas the remaining portions of the coin tubes are duller. This has the advantage that specular reflection effects and unwanted light are suppressed. The clarity of the windows can be produced by making tests in an injection mould.

To suppress the effect of unwanted light, which can also be light directed by the light-emitting element directly to the receiving element, the aspect of he invention provides that the inlet and outlet surface portions or the windows, at the outside of the coin tubes, are surrounded at least in part by a raised frame though which the light entering the coin tubes and exiting therefrom is impeded from unwantedly propagating crosswise to the beam axis. In such case, this reduces the risk of light from the tight-emitting element directly reaching the receiving element without traversing the coin tube.

Also, the prisms at the opposite side of the coin tubes may be surrounded, at the outside, at least in part by a raised frame which restricts the propagation of unwanted light and the penetration of unwanted extraneous light towards the prisms.

It is preferred that the frames of the windows are bordered by or bear against the side of the wall portion that faces then to deploy their beneficial impact.

It is known to manufacture the coin tubes from two cylinder halves and to join them to each other subsequently, e.g. by a catch or snap connection. In an aspect of the invention, a cassette-shaped assembly of the coin tubes is provided with the cassette assembly having two cup components each of which has the cylinder halves of the coin tubes. The cup components may be joined to each other by a catch or snap connection with a bolted joint being preferably added to firmly join the cup components to each other.

To give the cassette assembly a hold and facilitate an assembly within the casing of the money changer, according to the invention, a cover is provided which is U-shaped in cross-section and bears against one side, i.e. the front side of the cassette, and laterally grips around it by the leg-like portions. The cover can help in suspending the unit into receiving slots of the casing with catch portions of the cover interacting with catch openings of the casing to detachably locate the cassette units described in the casing.

According to another aspect of the invention, a provision is made for the light and receiving elements to be operated in a pulsed mode. However, such a mode of operation has become known from EP 088947 A2. Such pulsed mode of operation saves energy. Besides, inquiries made only during the operation time minimizes unwanted influences. As a result, the optical sensors exhibit high safety in operation.

The invention will be explained below in greater detail below with reference to an embodiment shown in the drawings.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated FIG. 1 schematically shows a section through some part of a money changer according to the invention.

FIG. 1*a* shows an enlarged view of a portion of the tube of FIG. 1 in the area of the windows.

FIG. 2 shows a front view of some part of a casing for a money changer.

FIG. 3 shows a side view of the casing of FIG. 2.

Figure 4:
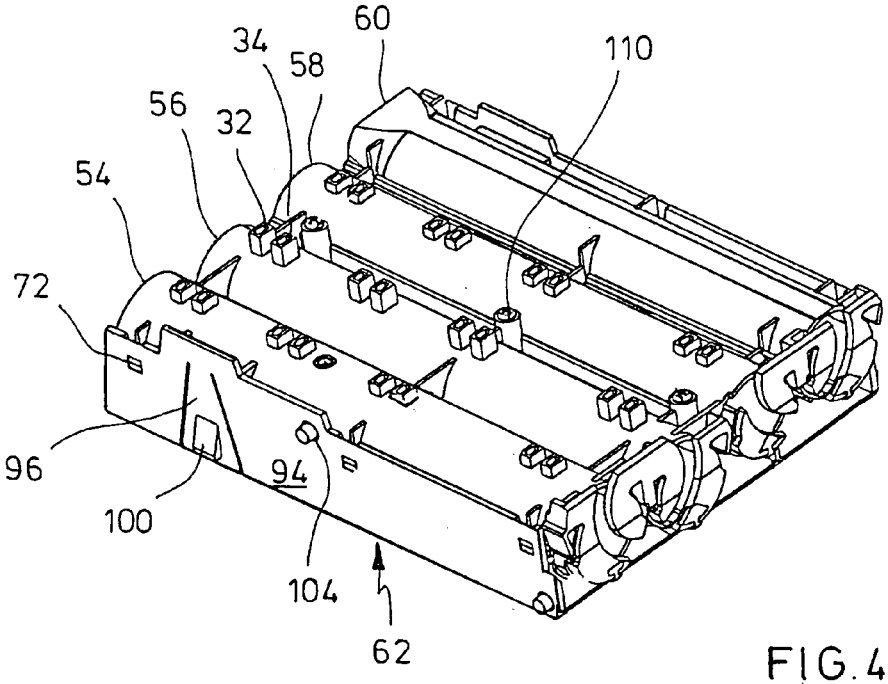
FIG. 4 shows a cassette assembly of coin tubes to be mounted in the casing of FIG. 2 or FIG. 3.

Referring to FIG. 1, a cylindrical coin tube is outlined at 10. The tube 10 houses a coin column 11. The tube 10 is made of a transparent plastic material. On the left-hand side, the coin tube is bordered by a wall portion 12 which forms part of a casing, which is not shown in detail, for a money changer. The casing generally is of a U-shaped cross-section and accommodates a coin validator in the upper region and the money changer in the lower region with the coins being stored in a series of coin tubes, which fact will be explicated later below. The side of the wall portion 12 that faces the coin tube 10 has disposed thereon a printed circuit board 14 which arranges the electronic components (not shown) which are required to operate a money changer. Moreover, it can be seen that a light element 16. e.g. in the form of an LED, and a light-sensitive receiving element 18 are arranged on the printed circuit board 14. The components are mounted by means of the SMD technique where the "sight-line" of the optical components is directed towards the coin tube 10 through openings 20, 22. The wall portion 12 is also provided with openings 24, 26 which are oriented to the openings 20, 22.

The coin tube 10 has "windows" at 28 and 30 They are integrally formed planarly with the coin tube 10 and are of a somewhat smaller wall thickness (not shown) than is the tube 10 in the remaining area. It is also possible to make the material clearer in the area of the windows 28, 30 than in the remaining area of the coin tube 10. The windows 28, 30 are each surrounded at least in part by a raised frame 32 and 34 with the frame being designed to bear against the wall portion 12, which is not shown in FIG. 1. They serve for preventing major amounts of flare light exiting towards the tube 10 from the opening 24, for example, from being deviated sidewards. Furthermore, the frame 34 prevents light arriving from the light element 16 from getting directly into the opening 26 and to the light element 18. A prism 36 is integrally formed with the coin tube 10 on the side opposite the superposed elements 16, 18. The prism is used to deflect the light beam 38 arriving from the light element 16 downwards and back to the receiving element 18. The reflected beam is indicated by 40. As was previously described the arrangement of a prism for a light barrier is known as such. At its outside, the prism is surrounded by a raised frame 42 which is also aimed at restricting the penetration of unwanted extraneous light into the prism.

As is apparent from FIG. 1*a* windows 28, 30 at the inside of the tube 10, are provided with recesses 29, 31 which prevent the tubes from getting scratched by coins.

The above-mentioned casing is outlined at 44 in FIGS. 2 and 3. It is U-shaped in cross-section with vertically extending side wall portions 46, 48 being formed on the sides of the wall portion 12. It can be seen from FIG. 2 that four gaps having four pairs of holes 24, 26 are provided. Each gap corresponds to a coin tube which are in front of the hole gaps (which is not shown). The upper pairs of holes 24, 26 serve to ascertain the upper filling level of the coin tube. The lower ones serve for determining the lower filling level. The middle ones serve for determining middle filling levels. One pair of holes each has associated therewith a light barrier assembly as is described in FIG. 1.

The side wall portions 46, 48 have receiving slots one of which is illustrated at 50. The slots 50 are open to the free edge of the wall portions 46, 48. A rectangular opening 52 is formed into the wall portions 46, 48 above the receiving slots 50. The slots and the opening will be referred to later below.

In FIG. 4 a series of four coin tubes 54 to 60 is illustrated in a perspective new. The cassette-type assembly of coin tubes 54 to 60 is surrounded by a cover 62 which is U-shaped in section. The lower ends of coin tubes 54 to 60 are equipped with facilities for coin delivery, which will not be referred to in detail, however. They are the state of the art.

Figure 5:
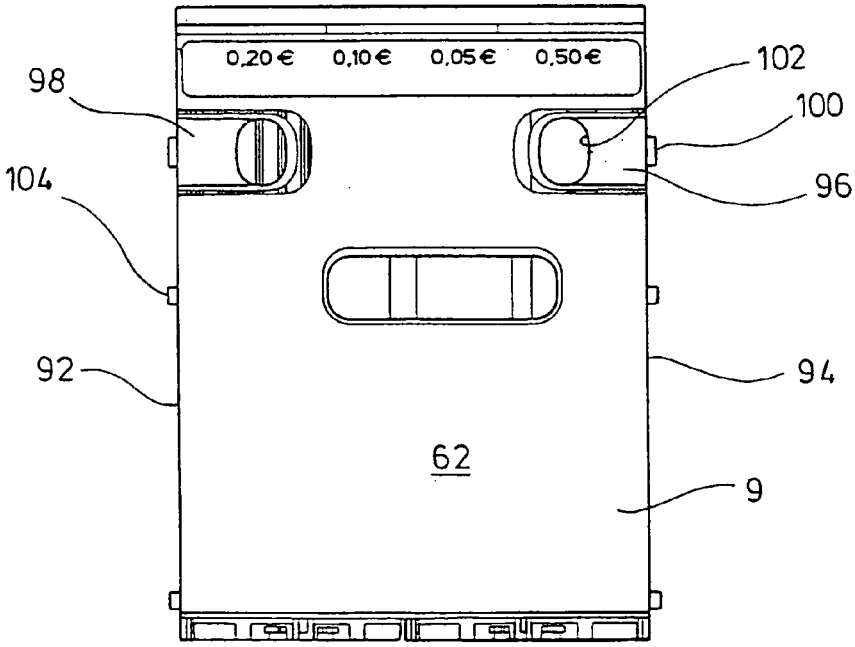
FIG. 5 shows a front view of the assembly of FIG. 4.

The side which can be recognized in FIG. 4 is the rear side of the assembly which faces the interior of the casing 44. It allows to see the frames 32, 34 of the windows 28, 30 which are oriented to the openings 24, 26 of the casing 44 when the unit shown in FIGS. 4 and 5 is built into the casing of FIGS. 2 and 3. However, this will be referred to in more detail later below.

Figure 6:
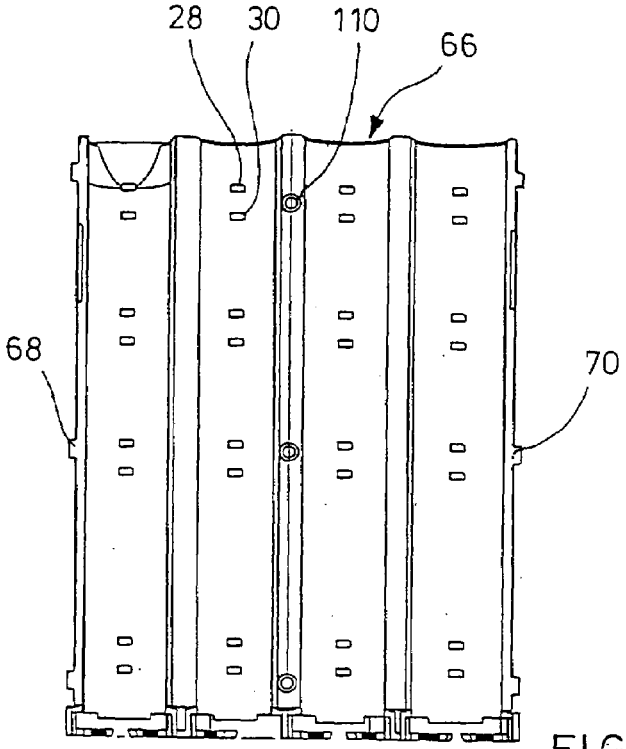
FIG. 6 shows the inside of the rear half-cup of the coin tubes of the assembly of FIG. 4.
Figure 7:
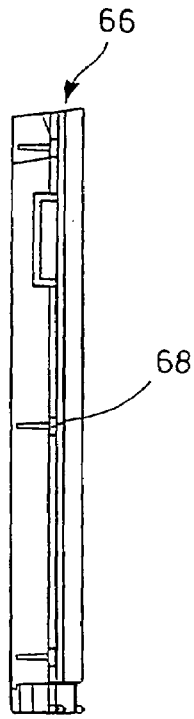
FIG. 7 shows a side view of the cap of FIG. 6.
Figure 8:
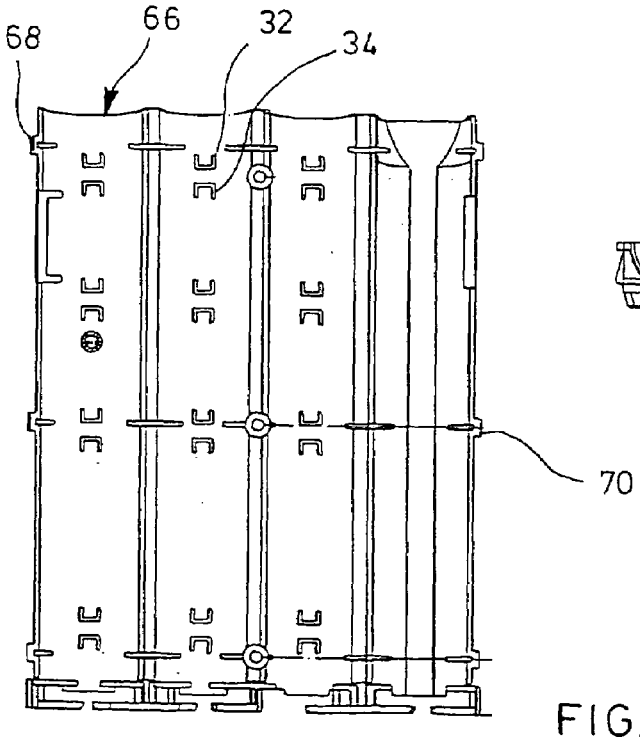
FIG. 8 shows the outside of the cup of FIGS. 6 and 7.
Figure 9:
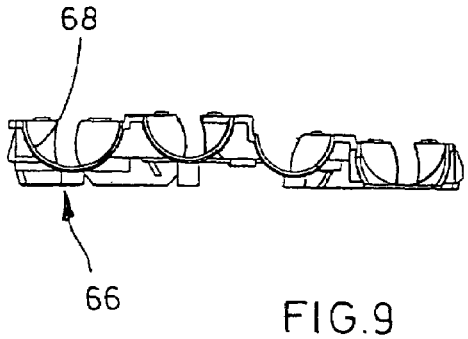
FIG. 9 shows a plan view of the cup of FIG. 8.
Figure 10:
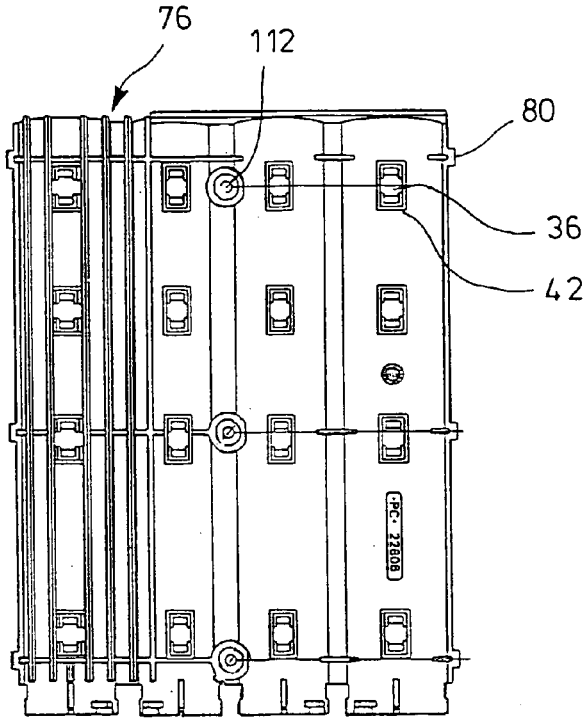
FIG. 10 shows the outside of the front cup of the assembly of FIG. 4.
Figure 11:
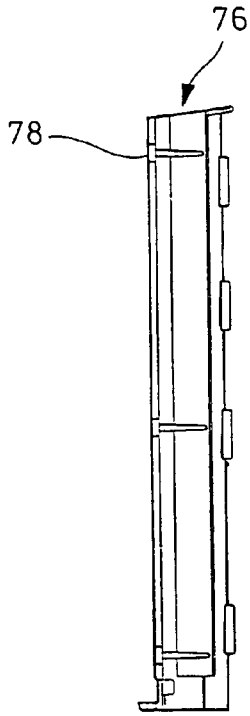
FIG. 11 shows a side view of the cup of FIG. 10.
Figure 12:
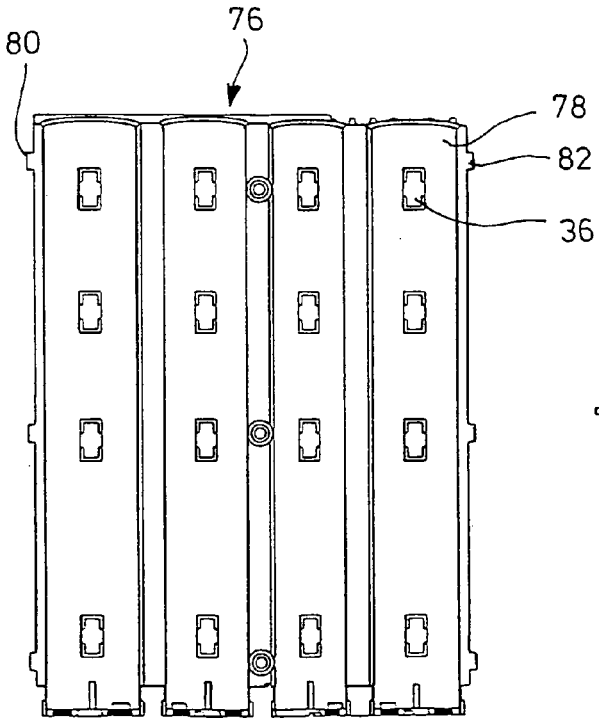
FIG. 12 shows the inside of the cup of FIGS. 10 and 11.
Figure 13:
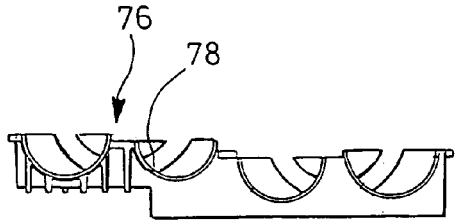
FIG. 13 shows a plan view of the cup of FIG. 12.

The coin tubes 54 to 60 are defined by two cups which form the cylindrical coin tubes together. FIG. 4 allows to see the cup directed towards the inside. This cup is shown from inside in FIG. 6 and from outside in FIG. 8. It is designated 66. The configuration of the cup 66 ensues from the overall view of FIGS. 6 to 8. They allow to see the rectangular windows 28, 30 in FIG. 6 and the frames 32, 34 in FIG. 8. FIG. 9 allows to see the cylinder halves 68 which form the corn tubes 54 to 60, along with cylinder halves of the second cup. At opposed edges at 68 and 70, the cup 66 has outwardly extending trunnions which are aligned with trunnions of the second cup and are opposite each other in order to snap into respective recesses of the cover 62. FIG. 4 illustrates recesses at 72.

In FIGS. 10 through 13, the second cup which defines the other cylinder halves 78 is indicated by 76. It can be seen that a series of four prisms 36 is associated with each cylinder half 78 which are surrounded by a raised frame 42. At the side edges, the cup 76 has trunnions 80, 82 which interact with the trunnions 68, 70 of the cup 66.

Figure 14:
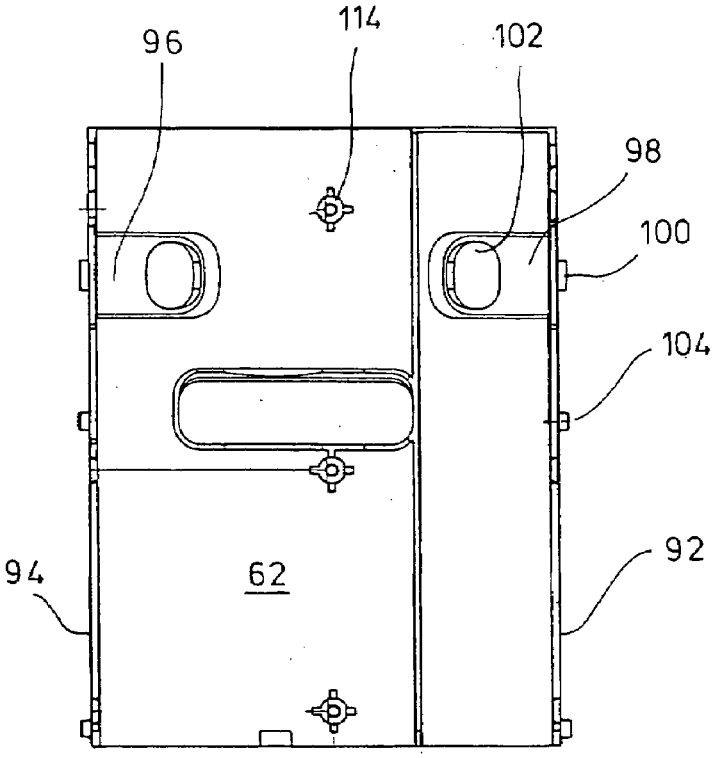
FIG. 14 shows the inside of a cover.
Figure 15:
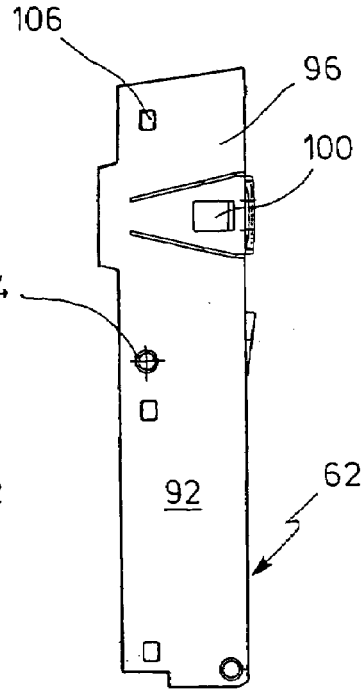
FIG. 15 shows a side view of the cover of FIG. 14.
Figure 16:
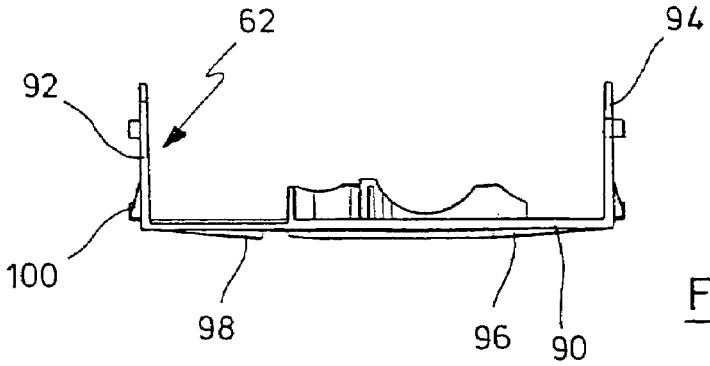
FIG. 16 shows a plan view of the cover of FIG. 14.

Another representation of the cover 62 (FIG. 4) can be seen in FIGS. 14 through 16. FIG. 14 shows the inside, FIG. 15 a side view, and FIG. 16 the plan view of the cover 62. FIG. 16 allows to see that the cover 62 is U-shaped in section and has a web-like wall portion 90 and leg-like wall portions 92, 94. Angular portions 96, 98 are formed in the upper region of the cover 62 and are hinged in the region of the side wall portions 92, 94 (sec FIG. 15) and have a nose 100 in the region of wall portion 90. The angular portions 96, 98 have a hole through which a finger can grasp to pull the nose 100 inwardly.

A trunnion 104 is externally formed each on the wall portions 92, 94. Further, catch apertures 106 are formed in the wall portions 92, 94.

The cups 66, 76 are held against each other during assembly with the lateral projections 68, 70, 80, 82 located against each other. Subsequently, the assembly is pushed into the U-shaped recess 62 as is shown in FIG. 4. This causes the projections 68, 70, 80, 82 located against each other to snap into the openings 72 of the cover 62 in order to hold the components against each other. Furthermore, they can also be mounted on top of each other by means of a bolted joint. For this purpose, the cup 66 has three threaded sockets 110 approximately in the longitudinal centre which are aligned with respective threaded sockets 112 of the cup 76. A screw which is passed through the sockets 110, 112 and is threaded into a socket 114 of the cover 62 can help in giving sufficient strength to the unit of FIGS. 4 and 5 to bear up the relatively high weight of the coins in the coin tubes 54 through 60.

The unit of FIG. 4 is then introduced into the casing of FIGS. 2 and 3. To this end, the trunnions 104 engage the receiving slot 50 of the casing side walls 46, 48, on the side wall portions 92, 94 of the cover 62. Furthermore, the noses 100 of the angular portions 96, 98 engage the catch opening 52. This way secures the cassette sufficiently within the casing, but allows to remove it simply by using a hand. The noses 100 are disengaged from the catch opening 52 by an actuation of the angular portions 98, 96 while putting a finger into the respective opening 102 to pivot the angular portions 98, 96.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. An apparatus for detecting a coin in a coin tube of a money changer for an automatic coin machine, comprising a casing in which a plurality of serially arranged tubes are mounted to store coins in a column shape, light barriers associated to the tubes at least in the upper and lower regions with each light barrier having a light-emitting element and a light sensitive receiving element which are superposed on the same side of the coin tube whereas the opposite side of the coin tube has arranged thereon a prism which reflects the received light back to the receiving element, and a control circuit for the money changer into which the output signals of the light receiving elements are entered, characterized in that the casing (44) has a wall portion (12) in parallel with the series of the coin tubes (54 to 60), a printed circuit board (14) for the control circuit is mounted on the opposite side on the wall portion (12) and carries the light-emitting elements (16) and receiving elements (18) which are directed towards the respective coin tube (56 to 60) via holes (20,22) in the printed circuit board (14) and in the wall portion (12).

2. The apparatus as claimed in claim 1, characterized in that a cassette-shaped assembly of the coin tubes (54 to 60) has two cup components (66, 76) each of which has the cylinder halves (68, 78) of the coin tubes 54 to 60).

3. The apparatus as claimed in claim 2, characterized in that a cassette assembly is enclosed by a cover (62), which is U-shaped in cross-section, and the cover (62) can be joined to the cassette assembly by means of a snap connection to form a unit.

4. The apparatus as claimed in claim 3, characterized in that said cover (62) is also manufactured from a transparent plastic.

5. The apparatus as claimed in claim 3, characterized in that said casing (44), on the two sides of the wall portion (12), has vertically extending, parallel-spaced wall portions (46, 48) into which a receiving slot (50) open to the free edge of the wall portion (46, 48) is formed each and the cover (62), in its leg-like wall portions (92, 94) at the outside, has trunnion-shaped projections (104) which are adapted to be introduced into said receiving slot (50) when the unit is inserted into said casing (44).

6. The apparatus as claimed in claim 5, characterized in that the cover (62), at the leg portions (92, 94) has a resilient portion (96, 98) with a catch portion (100 which engages a catch opening (52) of the side wall portions (46, 48).

7. The apparatus as claimed in claim 1, characterized in that the wall portion (12) has formed thereto locating means by which the printed circuit board (14) is located to the wall portion (12).

8. The apparatus as claimed in claim 1, characterized in that the light-emitting and receiving elements (16, 18) are operated in a pulsed mode.

9. The apparatus of claim 1 wherein each coin tube further includes windows made of a transparent material.

10. An apparatus for detecting a coin in a coin tube of a money changer for an automatic coin machine, comprising a casing in which a plurality of serially arranged coin tubes are mounted to store coins in a column shape, light barriers associated to the tubes at least in the upper and lower regions with each light barrier having a light-emitting element and a light sensitive receiving element which are superposed on the same side of the coin tube whereas the opposite side of the coin tube has arranged thereon a prism which reflects the received light back to the receiving element, and a control circuit for the money changer into which the output signals of the light receiving elements are entered, characterized in that the prisms (36) are integrally formed with the respective coin tube and the coin tubes (54 to 60) are made of a light-transmissive material and further wherein inlet and outlet surface portions for the light beam of a coin tube are defined by windows (28 to 30) where the transmission of light is markedly higher than in the rest of the coin tube.

11. The apparatus as claimed in claim 10, characterized in that the coin tubes have a wall thickness and the windows have a wall thickness whereby the wall thickness of the windows is smaller than the wall thickness of the coin tube.

12. The apparatus as claimed in claim 11, characterized in that said inlet and outlet surface portions of said windows (28, 30), at the outside of said coin tubes (54 to 60), are surrounded at least in part by a raised frame (32, 34) through which the light entering the coin tubes (54 to 60) and exiting therefrom is restricted from unwantedly propagating crosswise to the beam axis.

13. The apparatus as claimed in claim 10, characterized in that said prisms (36), at the outside of said coin tubes (54 to 60) are surrounded at least in part by a raised frame (42) which restricts the propagation of unwanted light and the penetration of unwanted extraneous light to the prisms (36).

14. The apparatus as claimed in claim 12, characterized in that said raised frames (32, 34) of the windows (28, 30) bear against the side of the wall portion (12) that faces them.

15. An apparatus for detecting a coin in a coin tube of a money changer for an automatic coin machine, comprising:

a casing;

a plurality of coin tubes being mounted in the casing, each coin tube being made of a light-transmissive material;

a light barrier associated with each coin tube, each light barrier having a light-emitting element and a light sensitive receiving element, the light-emitting element and the light sensitive receiving element being arranged on a first side of the coin tube, each light sensitive receiving element having an output signal;

a prism being arranged on each coin tube on a second side of the coin tube, the second side being opposite the first side, the prism reflecting the received light back to the light sensitive receiving element, each prism being integrally formed with their respective coin tube;

a control circuit which receives the output signals of the light sensitive receiving elements, and the coin tubes (54 to 60) have inlet and outlet surface portions which form windows (28, 30) that are surrounded at least in part by a raised frame (32, 34) through which the light entering and exiting said coin tubes (54 to 60) therefrom is restricted from unwantedly propagating crosswise to the beam axis.

16. The apparatus as claimed in claim 15, characterized in that the transmission of light is markedly higher in the region of the windows (28 to 30) than in the rest of the coin tube.

* * * * *